US005916104A

United States Patent [19]

Lucenet et al.

[11] Patent Number: 5,916,104

[45] Date of Patent: Jun. 29, 1999

[54] BOX, AN INSULATING SYSTEM, AND A GROUND DRAINAGE SYSTEM

[75] Inventors: Deborah Lucenet; David Lucenet, both of 19, Rue Barthélémy Nidlon, Fuveau, France, 13710

[73] Assignees: Chantal Boissie, Fuveau; Deborah Lucenet, Fuveau; David Lucenet, Fuveau

[21] Appl. No.: 08/898,900

[22] Filed: Jul. 23, 1997

[51] Int. Cl.[6] ..... E04C 2/288

[52] U.S. Cl. ..... 52/791.1; 52/794.1; 52/798.1; 52/789.1; 52/169.5; 405/43; 405/45; 210/170; 210/747; 210/289; 210/291

[58] Field of Search ..... 52/169.5, 169.11, 52/787.11, 791.1, 794.1, 798.1, 789.1; 405/43, 45; 210/747, 170, 289, 291

[56] References Cited

U.S. PATENT DOCUMENTS

| | | | |
|---|---|---|---|
| 1,051,344 | 1/1913 | Mcknight | 405/43 |
| 3,220,194 | 11/1965 | Lienard | 405/45 |
| 3,613,323 | 10/1971 | Hreha | 405/43 |
| 4,099,353 | 7/1978 | Blunt | 52/169.5 |
| 4,246,733 | 1/1981 | Haber | 52/309 |
| 4,483,640 | 11/1984 | Berger | 210/170 |
| 4,572,700 | 2/1986 | Mantarro et al. | 52/169.5 |
| 5,002,427 | 3/1991 | Kambe et al. | 405/45 |
| 5,111,627 | 5/1992 | Brown | 52/126.5 |
| 5,437,698 | 8/1995 | Furukawa | 52/791.1 |
| 5,562,819 | 10/1996 | Turner, Jr. et al. | 210/170 |
| 5,565,096 | 10/1996 | Phelan | 210/170 |
| 5,624,552 | 4/1997 | Vales et al. | 210/170 |
| 5,632,889 | 5/1997 | Tharp | 210/140 |
| 5,639,364 | 6/1997 | Houck et al. | 405/43 |
| 5,788,409 | 8/1998 | Johnson | 210/170 |

FOREIGN PATENT DOCUMENTS

| | | |
|---|---|---|
| 2691726 | 12/1993 | France . |
| 4021471 | 1/1992 | Germany . |
| 4304609 | 12/1993 | Germany . |

*Primary Examiner*—Carl D. Friedman
*Assistant Examiner*—Phi Dien Tran A
*Attorney, Agent, or Firm*—Ladas & Parry

[57] ABSTRACT

The technical field of the invention is that of building and public works, for example for lining the vertical walls of a building on the inside and/or on the outside, or for recovering water infiltrating through the ground in a plot. The present invention provides a closed insulating box in the form of a flat rectangular parallelepiped having two main faces in register which are spaced apart by four "lateral" faces. According to the invention, the six walls of the outer envelope of the box are rigid, thin, and made of a strong material, and at least one of the main walls is perforated by microholes, the main faces being interconnected by at least one internal stiffener, and the inside volume defined by the envelope is filled with rigid fragments of a granular material of cellular structure, and of relative density less than 1, and also having good thermal insulation properties.

16 Claims, 3 Drawing Sheets

BOX, AN INSULATING SYSTEM, AND A GROUND DRAINAGE SYSTEM

FIELD OF THE INVENTION

The present invention relates to boxes and insulating systems, and to systems for draining natural ground or made ground.

The technical field of the invention is that of building and public works.

One of the main applications of the invention is to line the outside vertical walls of a building, either on the inside for living quarters that are to be insulated, whether against sound or thermally, or on the outside for portions that are buried in the ground and that are to be insulated, whether against damp or thermally.

In the same field, the system of the invention can be used for making supports for floor slabs inside a building for which sound and thermal insulation are to be provided, and also to provide protection against rising damp.

Another application is recovering water that has infiltrated through the ground in a plot that is covered, for example, in crops that are to be watered.

BACKGROUND OF THE INVENTION

Various techniques are known for insulation and/or drainage, and in general each is adapted to the type of building and/or ground concerned, and at least for insulating walls, they make use of materials that are essentially artificial and/or natural, but that are reconstituted.

Thus, to insulate the outside vertical walls of a building, the inside surfaces thereof are generally lined with large sheets of plaster-board type material, or indeed of wood, or a genuine double partition is made of bricks or other stacked building materials, leaving a gap which is preferably filled with insulating material of the polystyrene type or of the rock or glass wool type, etc.

There also exist building materials that are themselves made up of various layers of material, some of which constitute a load-bearing core of the wall built up using such materials, while the others provide insulation, however that is suitable for use only in new buildings, and represents a manufacturing cost and an insulation cost that are relatively high.

Such techniques are indeed effective, at least so far as insulation is concerned, but they often need to be used together with other techniques to combat, in particular, damp, which often also reduces the lifetime and the effectiveness of techniques used for insulation purposes, or at least spoils the appearance of the materials used. Thus, no building material or method or technique is suitable for being used on its own directly for various applications such as insulating outside walls, floors, and foundations of outside walls, and more particularly none is suitable in the field of drainage.

When draining ground, in particular either near the foundations of a building, or a plot from which it is desired to recover water, or at least collect it for disposal elsewhere, after the water has infiltrated through the ground, the techniques generally used are of the type whereby trenches are dug around the structure to be protected, for example, and then filled with pebbles or other granular or powder materials which are poured in in bulk. It is thus possible to use a combination of layers of said pebbles or other material, overlying pipes that are pierced with orifices and that are laid at the bottoms of the trenches. In most cases, in order to prevent the drainage pipes and/or the inter-grain gaps in the material with which such a trench is filled from becoming clogged by earth entrained by water running from the surrounding plot which is to be drained or merely dried out in order to protect a building, the trench is lined, or at least that wall of said trench which is adjacent to the plot is lined prior to the pipes and/or the pebbles being put into place, the lining material being sheets of porous flexible material where porosity is ensured either by the material being woven or else by perforations.

Nevertheless, not only is it difficult to hold such sheets of flexible material against the walls of the trench while it is being filled, which in the case of collapse (rather frequent) reduces the effectiveness thereof, but also it is difficult to perform the work, since the use of pebbles or other heavy materials requires handling and transport equipment that is heavy and slow to operate, thereby increasing the cost of the operation. Extracting pebbles from quarries in rivers is an activity that is becoming more and more controlled and restricted.

OBJECTS AND SUMMARY OF THE INVENTION

The problem posed is thus to have prefabricated building elements available suitable for use both for insulation purposes, whether against sound or thermal, and also for making drainage systems, with this being done using the same basic technique, and to have building elements and materials of the same type using substances that are available either in nature or else on the market at low cost, with effectiveness being guaranteed over long periods of time, while nevertheless being simple and quick to install and use, using as little building-site equipment as possible, and with the overall cost of supplies and of installation being as low as possible.

A solution to the problem posed is a closed insulating box in the form of a flat rectangular parallelepiped having two "main" faces in register and spaced apart by four "lateral" faces; according to the invention, the fixed walls of the outer envelope of the box are rigid, thin, and made of a strong material, and at least one of said main faces is perforated by microholes, which main faces are interconnected by at least one internal stiffener, and the inside volume of the box as defined by its envelope is filled with rigid fragments of a granular material of cellular structure, having relative density of less than 1, and having good thermal insulation properties. The said granular material is preferably pozzolan.

Said box is constituted by a receptacle formed by one of the main faces secured to the four lateral faces, and by a cover which forms the other main face, which cover is fixed on said receptacle after it has been filled with the granular material.

In order to be able to assemble such boxes together quickly and effectively while ensuring continuity both of insulation and of the outside surfaces of the boxes when assembled against one another, at least two of the lateral faces in register of said boxes are provided, for one of them with at least one convex male projection extending outwards from the face supporting it, and for the other one of them, with at least one concave female depression extending inwards from the face supporting it and capable of co-operating with the male projection of another box placed against the first.

In one use of boxes of the invention, for the purpose of obtaining insulating or drainage systems over surfaces that are vertical, horizontal, or slightly inclined, the walls of said boxes are either all perforated or else only some of them are perforated, as explained in the following description and as shown in the embodiments in the accompanying figures.

The result is novel boxes and systems for insulation and drainage that satisfy the problem posed without suffering from the drawbacks of presently-known systems, and providing specific advantages, together with the possibility as mentioned above of using the same type of box of the invention either to insulate a wall, or to insulate a floor, or to provide drainage, while also being suitable, for various additional purposes, of being fitted with specific additional equipment for each of the desired uses.

Such boxes of the invention have main faces with dimensions of the order of 40 cm×80 cm, or 50 cm ×50 cm, i.e. they may be square in shape, and their lateral walls are 12 cm to 20 cm high; the walls can be made of HDPE and when the filler material is pozzolan, the weight of a box lies in the range 30 kg to 50 kg, so it can be carried by a single person and is thus easy to put into place and to stack without using special handling equipment. This weight is the maximum weight allowed by work regulations in France; the ability of the boxes to interlock relative to one another ensures that they are stable and can be aligned at least vertically without any need for the operator to deploy special block-laying skills.

In addition, the preferred choice of pozzolan as the granular material provides not only the advantage of low density which makes handling boxes of the invention that much easier, but also provides better temperature performance since pozzolan is a good insulator that always leaves empty passages between its grains, and it withstands frost well: its qualities are well known and it has been used since antiquity as aggregate for insulating cement in certain buildings close to the sites where it is produced, which sites include the Auvergne region of France and certain regions in Italy.

Pozzolan is a rock of volcanic origin that is cellular in structure, being formed by volcanic slag that has remained in the loose state, and that is to be found in very large quantities in volcanic ranges: its mechanical properties are, in particular, its low relative density of 0.980 due amongst other things to its porosity, and also its high capacity for thermal and sound insulation, its ability to withstand large and sudden changes of temperature, rough grains, a rich variety of various natural components, and also good specific rigidity and compactness, thereby preventing it from becoming crushed, good strength against shock and against wear, and good resistance to aggressive agents, all of which characteristics are well known and further details can be found by making reference elsewhere.

The use of this material has been developed in many applications, however until now it has never been used as raw material for insulation and drainage: furthermore, in spite of the many possible applications therefor, the quantity of this material actually used at present is rather low, so large quantities are available at reasonable cost, particularly since using it in boxes of the invention does not require a specific grain size to be used, given the rigidity of the walls making up the box and the size of the microholes. The holes allow water, air, or other fluids to pass through but they prevent grains of pozzolan passing through: nevertheless, the pozzolan is preferably selected to have grain sizes lying in mesh ranges 10/60 or 20/40, since grains that are too small in size would make the boxes heavier and would reduce the fluid flow effect which would be harmful to drainage, while grains that are too large in size would reduce the insulating effect and/or would require the boxes to be thicker.

Other advantages of the present invention could be mentioned, but those mentioned above suffice to demonstrate the novelty and the advantage of the invention.

BRIEF DESCRIPTION OF THE DRAWINGS

The following description and figures relate to embodiments of the invention, but they are not limiting in any way: other embodiments are possible within the ambit of the scope and the extent of the invention, in particular by changing the shape of the internal stiffeners and/or the interlock projections.

MORE DETAILED DESCRIPTION

Figure 1:
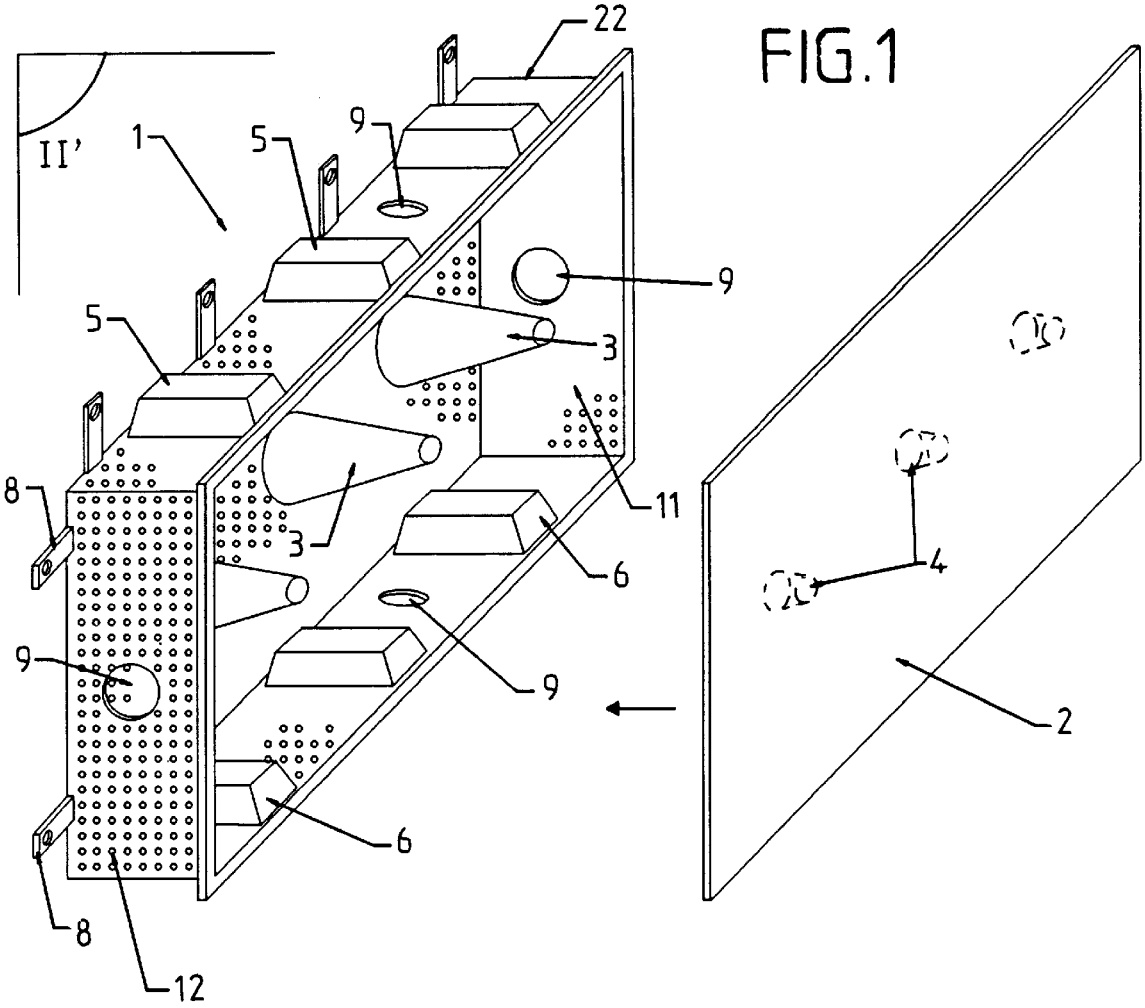
FIG. 1 is a perspective view of an open box of the invention.

In FIG. 1, an insulating box of the invention is in the form of a flat rectangular parallelepiped having two main faces in register that are spaced apart by four "lateral" faces, such that all six walls of its outer envelope are rigid, thin, (about 0.3 mm to 1.5 mm thick), made of a strong material of the high density polyethylene plastic type (HDPE), and having at least one of its "main" faces perforated by microholes 12, preferably being about 0.2 mm to 1 mm in diameter, and more preferably 0.2 mm to 0.6 mm; said main faces are interconnected by at least one internal stiffener 3, which is preferably of hollow shape.

The said box is constituted by a receptacle 22 constituted by one of its main faces integral with its four lateral faces, together with a cover 2 forming the other "main" face, said cover 2 being fixed to said receptacle after it has been filled with rigid fragments of a granular material 11 of cellular structure, which granular material is preferably pozzolan: having said boxes open via one of their large faces makes them easier to fill than through a lateral face, and said cover 2 is fixed by pressing the periphery thereof against a peripheral lip 7 surrounding the opening of the receptacle 22, and the assembly is then secured by cold or hot adhesive, staples, rivets, etc.

Figure 2:
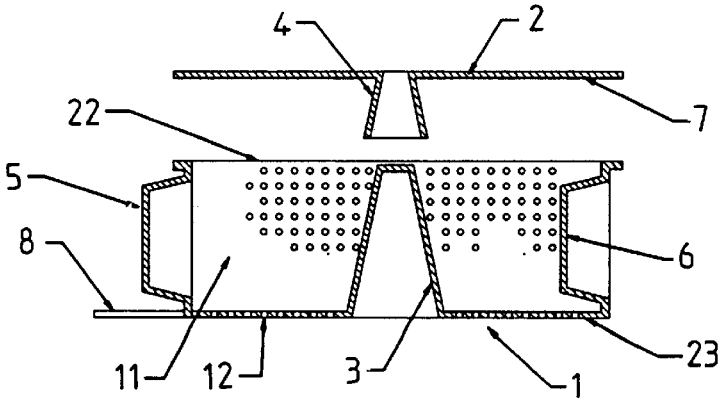
FIG. 2 is a section view on a plane II' including both the axis of a projection and the axis of an internal stiffener of the box of FIG. 1.
Figure 4:
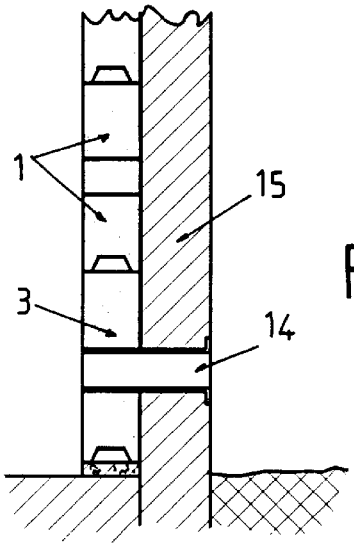
FIG. 4 is a section view of a wall insulated by a system of boxes, as shown in FIG. 3.

The said stiffeners 3, of which three are shown in FIG. 1, can be cylinders having a diameter of about 70 mm, as shown in FIG. 4, but they can also and preferably be in the form of truncated cones, having the same average diameter and as shown in FIGS. 1 and 2: their open, larger bases are secured to the main face constituting the bottom 23 of the box 1; their smaller faces co-operate with respective interlock cups 4 secured to the other main face constituting the cover 2, thereby centering it while it is being closed, providing better support, and better distribution of any loads that said box 1 may have to bear via its two opposite main faces 2 and 22.

Two of the lateral faces of said box 1 that are in register comprise:

for one of them, a male projection 5 and preferably two or three projections as shown in FIG. 1, each being outwardly convex from the face supporting it; and for the other one of them, at least one female depression 6, or two or three such depressions, in number and distribution matching that of the male projections, each of which depressions is concave relative to the face supporting it and is suitable for co-operating with a respective male projection 5 on another box placed against the first box; this way of assembling a plurality of boxes together by interlocking enables a continuous surface to be built up, as shown in FIGS. 3 to 8.

The section of FIG. 2 through said box 1 shows clearly the various features described above.

Figure 3:
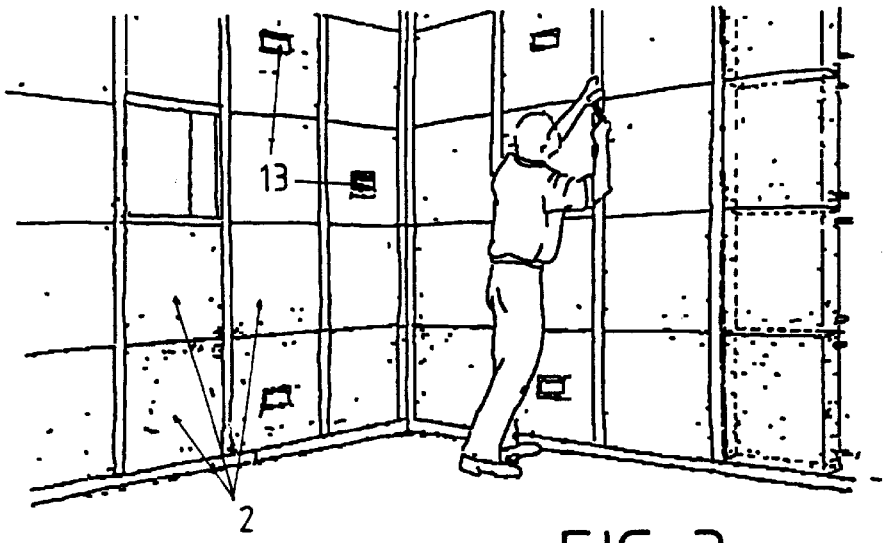
FIG. 3 is a perspective view of an embodiment of a system of the invention for insulating the inside of the outside walls of a building.
Figure 5:
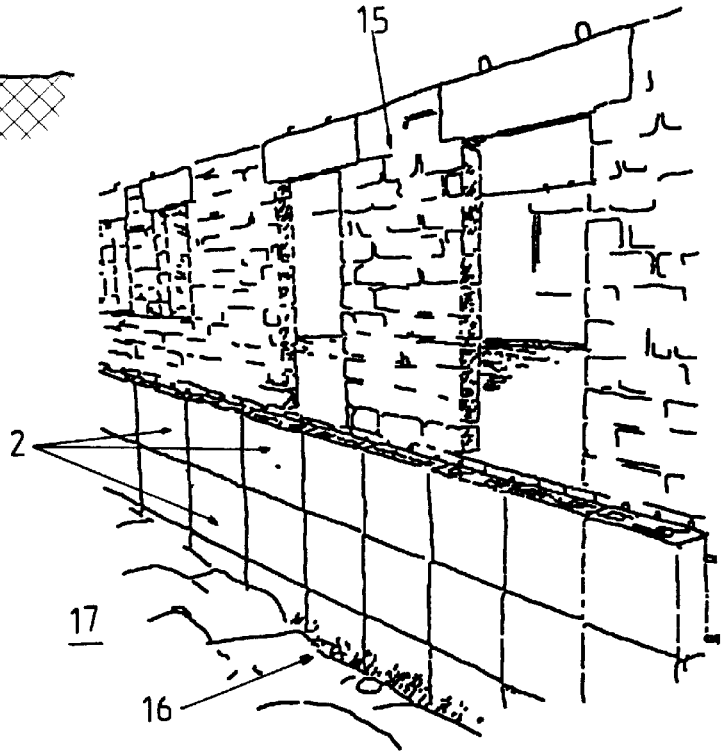
FIG. 5 is a perspective view of an example of implementing the system of the invention for insulating a foundation.

To facilitate installing said boxes 1, in particular over vertical surfaces, as shown in FIGS. 3 to 5, one of the main faces of each box, in practice the bottom 23 of the receptacle 22, includes at least three fixing tabs 8, each projecting outwards from three lateral faces and lying in the same plane as the main face 23 that supports them: for example, FIG. 1 shows four tabs projecting from the long side of the rectangle of the bottom 23 that is to be positioned pointing upwards, and two along each of its short sides; the other long side of the bottom 23 does not need such tabs and indeed they would get in the way since they would interfere with a box already in place.

To enable boxes that have been assembled relative to one another to be connected together, particularly and at least via the lateral faces which do not have the projections 5 and the depressions 6, the other two lateral faces in register, and possibly all of the lateral faces, include at least one orifice 9 having a diameter of about 50 mm, for example, which can be implemented in the form of a pre-hole which is closed while the box is being filled with the granular material, and which can quickly be removed on site so as to be connected to the adjacent orifice of a box placed side by side.

In the method of assembly shown in FIG. 3, which shows an insulating system constituted by a vertical assembly of boxes 1 of the kind described above, disposed against one another via their lateral faces, and also disposed against the inside face of an outside wall 15 of a building, all of the faces of said boxes 1 are perforated; some of the main faces facing towards the inside of the building may include internal ventilation grids 13, and preferably one grid in the box situated at floor level another grid in the box situated at ceiling level, so as to ensure that air can flow between the top and the bottom of the room insulated in this way.

To ensure that outside air can also be fed in, at least one of the internal stiffeners 3 in one of said boxes 1, preferably a box placed at floor level, is hollow and perforated, and is connected to an outside air inlet 14 pierced through said wall 15, as shown in FIG. 4.

In this particular application of sound and thermal insulating of the inside of a building, said boxes 1 may also include electrical resistors with heating probes disposed inside their volume 11 and connected to any appropriate electricity supply for the purpose of diffusing heat into the room insulated in this way.

In an application to insulating and draining the foundations of a building, for example, and as shown in FIG. 5, five of the faces of said boxes 1 are perforated, with the exception of one of the main faces 2 corresponding to the covers thereof, since the bottoms, which are the fixing faces, are placed against the wall; said covers 2 extend vertically facing towards the ground 17 from which the building is to be insulated.

Said boxes 1 are then disposed in a trench 16 dug around said building to enable them to be put into place, said trench 16 possibly being quite narrow so that the boxes are slid therein.

Figure 6:
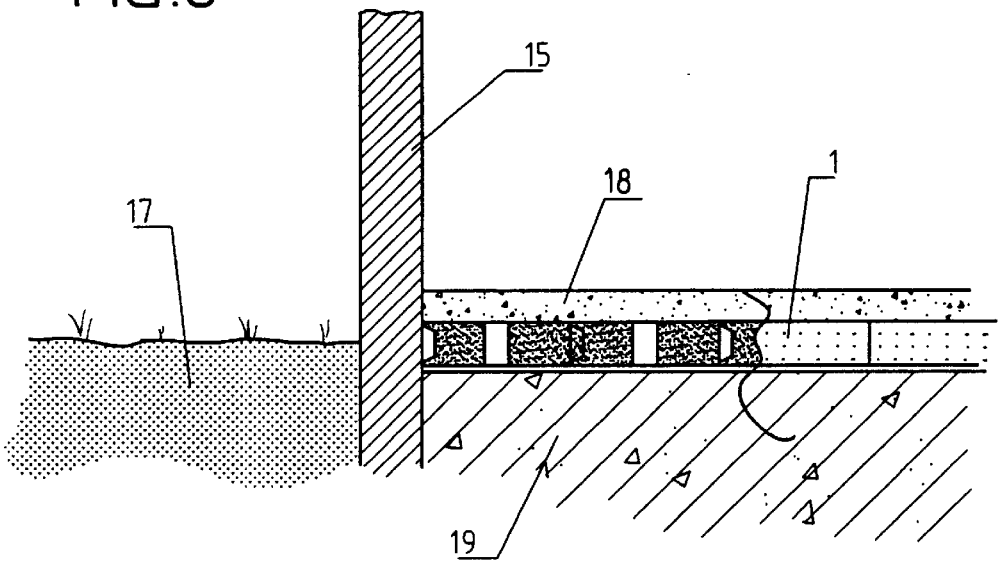
FIG. 6 shows, in section, an implementation of a system of the invention for insulating a floor.

In a use as shown in FIG. 6, said boxes 1 serve to insulate a floor against sound and against damp, with the floor being constituted, for example, by a concrete slab 18 cast over the boxes, which are themselves laid on subsoil 19 that may be constituted by ungraded sand-and-gravel; in this case, the boxes 1 are perforated in all of their faces.

Figure 7:
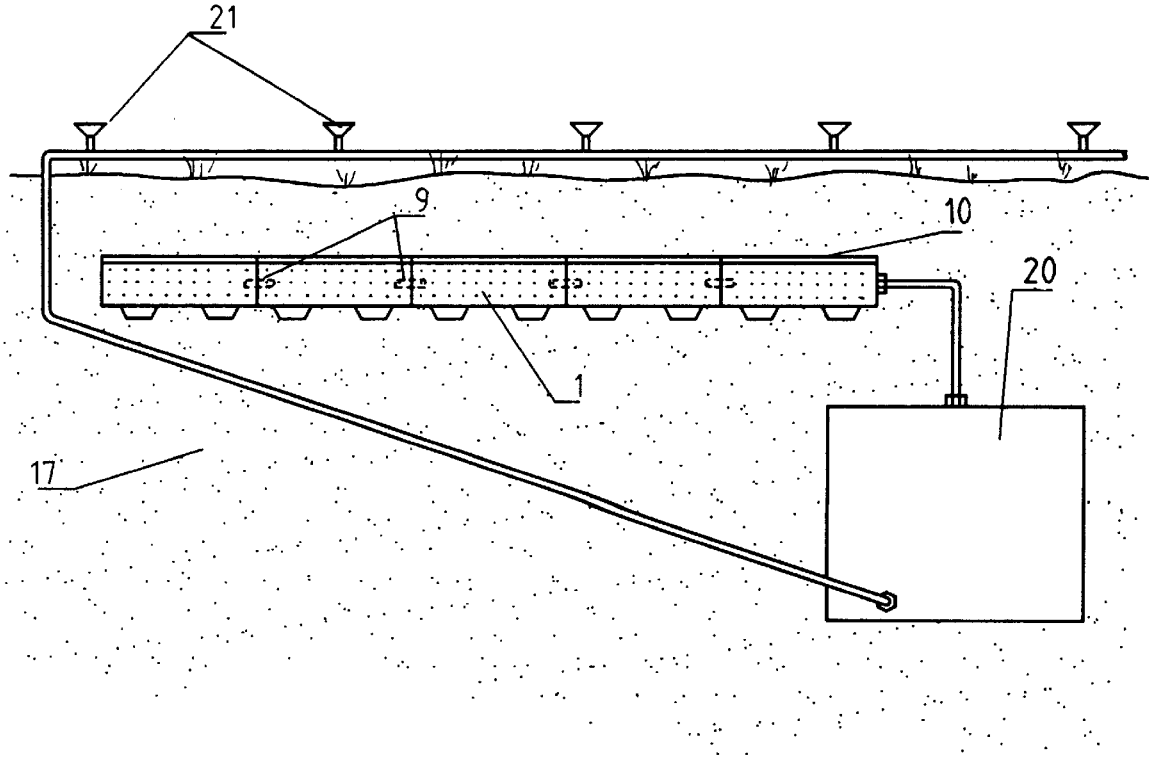
FIG. 7 is a section view of an embodiment of the system of the invention for draining and recovering water that infiltrates through a plot of ground after being watered.

FIG. 7 shows another particular example of how a box of the invention can be used: a drainage system is constituted by an assembly of boxes lying in a horizontal plane, placed against one another via their lateral faces, and such that only their upwardly-directed main faces are perforated, with the overall plane constituted by the assembled-together boxes 1 sloping. The boxes are interconnected by sleeves passing through the facing orifices 9, and at least one drainage tank 20 is placed below the lowest box 24 and is connected at least to said lowest box.

The drainage tank 20 can then also be connected to a filter and pumping system enabling the water recovered in this way to be reused via a pipe that returns to above the surface of the ground for the purpose of watering 21 the ground overlying the recovery system constituted by said boxes 1; thus, apart from losses to evaporation and to water absorption by the plants that are to be watered, and some water loss to adjacent ground, the major portion of the water is recycled, thereby reducing the overall rate at which water is consumed for watering purposes.

In this application, the boxes 1 may be covered in a geotextile fiber of the "Bidim" (trademark) type to protect them, said geotextile allowing water to infiltrate into said boxes 1 and preventing the microholes 12 in the upwardly-directed main face from clogging, which would prevent them from recovering water.

Such boxes of the invention, laid like those of FIG. 7, either vertically in trenches or horizontally and optionally in successive superposed layers, with pozzolan of larger or smaller grain sizes as a function of the depths of said boxes relative to one another, can be used to implement filter systems for waste, e.g. waste from self-contained septic units or from livestock units for treating manure by spreading, e.g. pig manure. In presently known systems, such spreading occupies fields of very large area with drainage systems that are difficult to control, whereas a satisfactory alternative can be provided using filter boxes of the invention, i.e. either vertically in trenches or else superposed and/or laid flat side by side, and perforated in at least two of their horizontal faces, the boxes including pozzolan having different grain sizes in the range 0/02 to 15/25, for example, and having a bottom volume that is watertight for recovering filtered effluent in the bottom portion of the filtering excavation formed in this way. When using superposed boxes, each row of boxes can have different perforations to determine flow time, and when using vertical boxes they can have horizontal partitions that are perforated to perform the same function while also serving as stiffeners. Carefully-performed tests have shown that using pozzolan under such conditions makes it possible to comply with requirements drawn up by authorities concerned with applications of this type.

We claim:

1. A closed insulating box in the form of a rectangular parrallelepiped that is flat with two main faces in register and spaced apart by four lateral faces such that the box has an external envelope with six walls, all six walls of the external envelope of the box being rigid, thin, and made of strong material, the main faces being interconnected by at least one internal stiffener, and an inside volume of the box as defined by the envelope being filled with rigid fragments of a granular material that has good thermal insulating properties, wherein at least one of said main faces is perforated by microholes, and said granular material is of cellular structure, has relative density of less than 1, and consists essentially of pozzolan.

2. An insulating box according to claim 1, constituted by a receptacle formed by one of its main faces secured to the four lateral faces, and by a cover forming the other main face, said cover being fixed on said receptacle after it has been filled with the granular material.

3. A box according to claim 1, wherein at least a first and a second of the lateral faces are in register with the first lateral face including at least one convex male projection projecting outwards from the first lateral face and at least the second lateral face including at least one concave female depression extending inwards from the second lateral face and suitable for co-operating with a male projection of another box placed against the closed insulating box.

4. A box according to claim 1, wherein at least two of the lateral faces are in register and include at least one respective orifice.

5. An insulating box according to claim 1, wherein one of the main faces includes at least three fixing tabs, each of said tabs projecting outwards from a respective one of the lateral faces, and lying in the plane of said main face.

6. An insulating box according to claim 1, wherein said at least one internal stiffener is hollow in shape.

7. An insulating box according to claim 1, wherein said at least one stiffener is a truncated cone having an open larger base secured to a first of the main faces constituting the bottom of the box, and a smaller base co-operating with interlock cups secured to another of the main faces, constituting the cover.

8. An insulating box according to claim 1, wherein said microholes have a diameter lying in the range 0.2 mm to 1 mm.

9. An insulating box according to claim 1, wherein the strong material from which the walls of said box are made is high density polyethylene and the thickness of said walls lies in the range 0.3 mm to 1.5 mm.

10. An insulating system constituted by assembling together boxes according to claim 1, being disposed against one another via their lateral faces, and wherein all the faces of said boxes are perforated by said microholes.

11. An insulating system constituted by assembling ether boxes according to claim 1, placed against one another via their lateral faces, and wherein five of said faces are perforated, with the exception of one of the main faces.

12. A drainage system constituted by assembling together boxes according to claim 1, disposed in a substantially horizontal plane against one another via their lateral faces, and wherein only the upwardly-facing main face of each box is perforated, the entire plane constituted by the assembled-together boxes sloping, the boxes being connected to one another via sleeves disposed in the facing orifices, the system also including at least one drainage tank located lower than the lowest box and connected at least to said lowest box.

13. An insulating box as claimed in claimed 1 wherein the granular material consists of pozzolan.

14. An insulating system according to claim 10, wherein said boxes are fixed to the inside of a wall of a structure and at least one internal stiffener is hollow and perforated, being connected to an air inlet of said wall.

15. An insulating system comprising a wall of a structure and a plurality of boxes for insulating said wall, each of said boxes comprising a rectangular parallelopiped that is flat with two main faces in register and spaced apart by four lateral faces such that the box has an external envelope with six walls, all six walls of the external envelope of the box being rigid, thin, and made of strong material, the main faces being interconnected by at least one internal stiffener, and an inside volume of the box as defined by the envelope being filled with rigid fragments of a granular material that has good thermal insulating properties, wherein at least one of said main faces is perforated by microholes, and said granular material is of cellular structure, has relative density of less than 1, and consists essentially of pozzolan, said plurality of boxes being assembled with one of the lateral faces of a first of the boxes disposed against one of the lateral faces of a second of said boxes, said assembled boxes being disposed with one of the main faces of each of the plurality of boxes abutting the wall.

16. A method for insulating a surface comprising (a) providing a plurality of boxes for insulating said surface, each of said boxes comprising a rectangular parellelopiped that is flat with two main faces in register and spaced apart by four lateral faces such that the box has an external envelope with six walls, all six walls of the external envelope of the box being rigid, thin, and made of strong material, the main faces being interconnected by at least one internal stiffener, and an inside volume of the box as defined by the envelope being filled with rigid fragments of a granular material that has good thermal insulating properties, wherein at least one of said main faces is perforated by microholes, and said granular material is of cellular structure, has relative density of less than 1, and consists essentially of pozzolan; and (b) assembling said boxes with one of the lateral faces of a first of the boxes disposed against one of the lateral faces of a second of the boxes and with one of the main faces of each of the plurality of boxes abutting the surface.

* * * * *